United States Patent [19]

Lynn, Jr.

[11] Patent Number: 4,892,230

[45] Date of Patent: Jan. 9, 1990

[54] CARBONATED BEVERAGE BOTTLE

[76] Inventor: Arthur E. Lynn, Jr., Rte. 7, Box 218-A, Andalusia, Ala. 36420

[21] Appl. No.: 244,111

[22] Filed: Sep. 14, 1988

Related U.S. Application Data

[63] Continuation-in-part of Ser. No. 152,987, Feb. 8, 1988, abandoned.

[51] Int. Cl.[4] ..... B65D 35/56

[52] U.S. Cl. ..... 222/105; 222/183; 222/386.5; 222/484; 220/462; 215/6

[58] Field of Search ..... 222/105, 386.5, 484, 222/183; 215/11.3, 12.1, 6; 383/906; 220/404, 462, 463, 403

[56] References Cited

U.S. PATENT DOCUMENTS

| | | | |
|---|---|---|---|
| 2,816,690 | 12/1957 | Lari | 222/386.5 |
| 3,349,965 | 10/1967 | Krugger | 222/105 |
| 3,450,254 | 6/1969 | Miles | 220/404 |
| 3,484,011 | 12/1969 | Greenhalgh et al. | 222/183 |
| 3,696,969 | 10/1972 | De Van et al. | 222/183 |
| 4,623,075 | 11/1986 | Riley | 222/183 |

*Primary Examiner*—H. Grant Skaggs
*Attorney, Agent, or Firm*—Kelly O. Corley

[57] ABSTRACT

A container for dispensing and storing carbonated beverages, having an outer rigid bottle and an inner collapsible non-elastomeric pouch. A valve mechanism admit air to an air space between the outer bottle and the inner pouch when liquid is dispensed, and seals the air space when the bottle is closed.

2 Claims, 1 Drawing Sheet

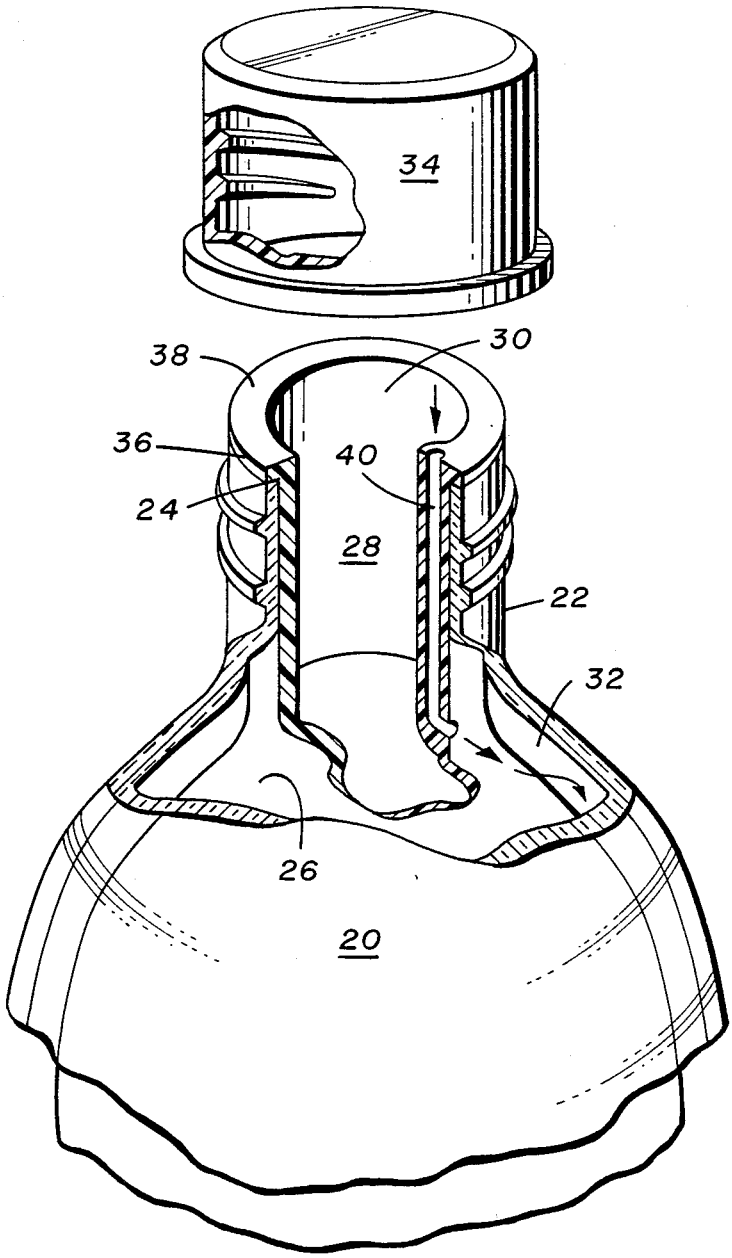
34
38
30
36
40
24
28
22
32
26
20

CARBONATED BEVERAGE BOTTLE

This is a continuation-in-part of copending application Ser. No. 152,987, filed Feb. 8, 1988, now abandoned.

The invention relates to the art of bottles, and more particularly to the art of bottles for storing and dispensing carbonated liquids.

Carbonated beverages were traditionally sold in small containers holding enough beverage for a single serving. More recently, larger containers have been introduced holding multiple servings, such as the currently common two liter and three liter bottles. With the larger containers has come the problem that when part of the beverage is dispensed and the remaining beverage is stored, the stored beverage tends to lose its carbonation and become "flat", even though the bottle cap is replaced and tightly secured.

One prior approach to solving this problem is disclosed in Putnam U.S. Pat. No. 4,531,655, which provides an outer rigid support container with an inner collapsible fluid container, and a valve or sealing assembly for closing the neck of the collapsible container. Putnam provides a pressure equalizing aperture through the wall of the support container and communicating with the air space between the outer and inner containers to permit collapse of the inner container as liquid is dispensed therefrom. In such a structure, however, the collapsible container will freely expand toward the outer bottle as carbon dioxide escapes from the remaining liquid and raises the pressure above the liquid to greater than ambient atmospheric pressure. This is accordingly ineffective in preventing loss of carbonation, as well as being evidently considerably more expensive than the ordinary bottle.

According to the present invention these and other difficulties of the prior art are avoided by provision of a simple and economical container modified so as to reduce loss of carbonation by the stored partial contents.

According to a first major aspect of the present invention, there is provided an improved container for storing and dispensing a carbonated liquid, the container comprising a substantially rigid outer container in the form of a bottle having a neck extending upwardly to a bottle mouth defined by an annular upper rim, the bottle being otherwise imperforate. An inner collapsible pouch is disposed within the bottle for containing the liquid, the pouch being substantially non-elastomeric and being impervious to liquids and to carbon dioxide gas. The pouch has a neck extending upwardly through the neck of the bottle and is otherwise imperforate to thereby define with the bottle an air space between the pouch and the bottle. The neck of the pouch terminates in an upper open mouth whereby the liquid may be poured from the pouch. Cap means are provided for closing the open mouth, and valve means are provided for admitting air from the ambient atmosphere outside the improved container into the air space when the cap means is removed from the pouch and for isolating the air space both from the inner pouch and from the ambient atmosphere when the cap means is installed, whereby the air inside the air space is compressed by carbon dioxide escaping from the liquid while the cap means is installed.

According to another aspect of the invention, the valve means comprises an annular flange integral with the neck of the pouch, the flange extending radially outwardly and having a lower surface resting on the upper rim of the bottle, the flange further having an upper generally planar surface adapted for sealing contact with the interior of the cap means when the cap means is installed; and wall means defining a passageway from the upper surface of the flange to the air space when the cap means is not installed.

These and other aspects of the invention will in part be disclosed below and will in part be apparent from the following detailed description taken together with the accompanying drawing wherein:

The single FIGURE is a perspective view, partly broken away and partly exploded, of the upper portions of the preferred improved container according to the invention.

As illustrated in the FIGURE, the invention comprises a substantially rigid outer container 20 in the form of a conventional bottle having neck 22 extending upwardly to a bottle mouth defined by an annular upper rim 24. Aside from the bottle mouth, container 20 is otherwise imperforate. Collapsible inner pouch 26 is disposed within bottle 20 for containing the liquid, and is formed from a substantially non-elastomeric material which is impervious to the liquid and to carbon dioxide gas, such as from one of the various known plastic films. Pouch 26 has neck 28 extending upwardly through bottle neck 22. Neck 28 terminates in upper open mouth 30 whereby liquid contained in pouch 26 may be dispensed. Pouch 26 is otherwise imperforate. Air space 32 is provided between the inner surface of bottle 20 and the outer surface of pouch 26, and cap means 34 is provided for selectively closing and opening mouth 30. Cap means 34 is preferably a conventional bottle cap with internal threads so that it may be screwed onto external threads on bottle neck 22.

Annular flange 36 is integral with neck 28 at mouth 30 and extends radially outwardly therefrom. Flange 36 has a lower surface resting on upper rim 24 of bottle 20 and forming a seal therewith. Flange 36 has an upper generally planar surface 38 adapted for sealing contact with the interior of cap means 34 when cap means 34 is installed. Wall means in neck 28 define passageway 40 from upper surface 38 to air space 32 when cap means 34 is not installed. Neck 28 is preferably considerably thicker and more rigid than the remainder of pouch 26, especially in the vicinity of passageway 40. Upper surface 38 and passageway 40, in cooperation with cap means 34, accordingly constitute valve means for admitting air from the ambient atmosphere outside bottle 20 into air space 32 when cap 34 is removed from pouch 20, and for isolating air space 32 both from the interior of pouch 26 and from the ambient atmosphere when cap 34 is installed.

The container as thus described operates as follows. When cap 34 is removed and part of the liquid is removed, pouch 26 partially collapses and a corresponding volume of ambient air flows through passageway 40 into air space 32. When cap 34 is reinstalled, its inner surface mates with and seals against upper surface 38, closing passageway 40 and sealing the only access to air space 32. As carbonation from the remaining liquid escapes into the space above the liquid in pouch 26, pressure builds and pouch 26 expands. However, the air trapped in air space 32 is thereby compressed between rigid bottle 20 and the expanding pouch. This compression of the air in air space 32 resists expansion of pouch 26 and thereby reduces the amount of carbon dioxide that can escape into the space above the remaining liquid. This is in direct contrast to the operation of the structure disclosed in the Putnam patent noted above.

I claim:

1. An improved container for storing and dispensing a carbonated liquid, said container comprising:

a. a substantially rigid outer container in the form of a bottle having a neck extending upwardly to a bottle mouth defined by an annular upper rim, said bottle being otherwise imperforate;

b. an inner collapsible pouch disposed within said bottle for containing said liquid, said pouch being formed from a substantially non-elastomeric material which is impervious to liquids and to carbon dioxide gas, said pouch having a neck extending upwardly through said neck of said bottle and being otherwise imperforate to thereby define with said bottle an air space between said pouch and said bottle, said neck of said pouch terminating in an upper open mouth whereby said liquid may be poured from said pouch;

c. cap means for closing said open mouth; and d. valve means for admitting air from the ambient atmosphere outside said improved container into said air space when said cap means is removed from said pouch and for isolating said air space both from the interior of said inner pouch and from said ambient atmosphere when said cap means is installed, whereby said air inside said air space is compressed by carbon dioxide escaping from said liquid while said cap means is installed.

2. The improved container defined in claim 1, wherein said valve means comprises:

a. an annular flange integral with said neck of said pouch, said flange extending radially outwardly and having a lower surface resting on said upper rim of said bottle, said flange further having an upper generally planar surface adapted for sealing contact with the interior of said cap means when said cap means is installed; and b. wall means defining a passageway from said upper surface of said flange to said air space when said cap means is not installed.

* * * * *